US008816927B2

(12) United States Patent
Nakano et al.

(10) Patent No.: US 8,816,927 B2
(45) Date of Patent: Aug. 26, 2014

(54) ANTENNA UNIT, AND ELECTRONIC APPARATUS INCLUDING THE SAME

(75) Inventors: Kazuya Nakano, Kanagawa (JP); Kenji Nishikawa, Hyogo (JP); Kazuya Tani, Osaka (JP)

(73) Assignee: Panasonic Corporation, Osaka (JP)

( * ) Notice: Subject to any disclaimer, the term of this patent is extended or adjusted under 35 U.S.C. 154(b) by 246 days.

(21) Appl. No.: 13/039,462

(22) Filed: Mar. 3, 2011

(65) Prior Publication Data

US 2011/0227803 A1 Sep. 22, 2011

(30) Foreign Application Priority Data

Mar. 18, 2010 (JP) ..... 2010-062753

(51) Int. Cl.
*H01Q 1/24* (2006.01)
*H01Q 19/10* (2006.01)
*H01Q 1/22* (2006.01)

(52) U.S. Cl.
CPC ..... *H01Q 1/243* (2013.01); *H01Q 1/2266* (2013.01)
USPC ..... 343/834; 343/702

(58) Field of Classification Search
USPC ..... 343/702, 834, 700 MS
See application file for complete search history.

(56) References Cited

U.S. PATENT DOCUMENTS

| | | | | |
|---|---|---|---|---|
| 4,494,120 | A * | 1/1985 | Garay | 343/702 |
| 4,584,585 | A * | 4/1986 | Marko et al. | 343/702 |
| 5,138,328 | A * | 8/1992 | Zibrik et al. | 343/702 |
| 6,031,731 | A | 2/2000 | Suesada et al. | |
| 6,686,886 | B2 * | 2/2004 | Flint et al. | 343/702 |
| 6,724,348 | B2 | 4/2004 | Fang | |
| 7,183,994 | B2 * | 2/2007 | Weigand | 343/795 |
| 7,242,353 | B2 | 7/2007 | Hung et al. | |
| 7,271,769 | B2 | 9/2007 | Asano et al. | |
| 7,365,685 | B2 | 4/2008 | Takeuchi et al. | |
| 7,525,486 | B2 * | 4/2009 | Shtrom et al. | 343/700 MS |
| 8,102,296 | B2 | 1/2012 | Tarng et al. | |
| 8,111,195 | B2 | 2/2012 | Hung et al. | |
| 2003/0181227 | A1 | 9/2003 | Toshiyuki | |
| 2003/0184484 | A1 | 10/2003 | Ikegaya et al. | |
| 2005/0275595 | A1 | 12/2005 | Endo et al. | |
| 2006/0038723 | A1 | 2/2006 | Watanabe et al. | |
| 2006/0139230 | A1 | 6/2006 | Shirosaka et al. | |
| 2009/0073059 | A1 * | 3/2009 | Ikegaya | 343/702 |
| 2009/0215487 | A1 | 8/2009 | Chang et al. | |

FOREIGN PATENT DOCUMENTS

| | | |
|---|---|---|
| EP | 0788186 | 8/1997 |
| EP | 1814195 | 8/2007 |
| JP | 11-031909 | 2/1999 |
| JP | 2001-168629 | 6/2001 |
| JP | 2003-258520 | 9/2003 |
| JP | 2003-283232 | 10/2003 |
| JP | 2004-241803 | 8/2004 |
| JP | 2004-241837 | 8/2004 |

(Continued)

*Primary Examiner* — Hoang V Nguyen
*Assistant Examiner* — Patrick Holecek
(74) *Attorney, Agent, or Firm* — Hamre, Schumann, Mueller & Larson, P.C.

(57) ABSTRACT

A GPS antenna is provided with a reflective conductor portion. Thereby, an electromagnetic wave radiated from an antenna conductor portion in a predetermined direction can be grounded electrically, and thus radiation of the electromagnetic wave in a direction (arbitrary direction) opposite to the predetermined direction can be enhanced. As a result, the directivity of the electromagnetic wave in the arbitrary direction can be enhanced to improve the positioning accuracy.

6 Claims, 7 Drawing Sheets

(56) References Cited

FOREIGN PATENT DOCUMENTS

| | | |
|---|---|---|
| JP | 2004-343285 | 12/2004 |
| JP | 2005-110110 | 4/2005 |
| JP | 2006-5441 | 1/2006 |
| JP | 2006-211643 | 8/2006 |
| JP | 2007-6197 | 1/2007 |
| JP | 2009-38507 | 2/2009 |
| JP | 4305282 | 5/2009 |

* cited by examiner

ANTENNA UNIT, AND ELECTRONIC APPARATUS INCLUDING THE SAME

BACKGROUND

1. Field

The present application relates to an antenna unit and an electronic apparatus including the same.

2. Description of Related Art

Recently, GPS (Global Positioning System) antennas capable of receiving electromagnetic waves radiated from GPS satellites are packaged in car navigation systems, notebook PCs (personal computers), mobile phone terminals and the like. Ideally, an antenna to be packaged in such equipment is a surface-mounting type antenna with a sensitive radiation directivity, which easily forms a circular polarization, and the examples include a patch antenna and a planar inverted-F antenna. Actually however, due to some restrictions in packaging, for example an inverted-F antenna that can be formed in s simple manner also has been used. JP 2005-110110 A, JP 2004-343285 A, and JP 2003-283232 A disclose such inverted-F pattern antennas.

In a case of integrating the inverted-F GPS antenna in an electronic apparatus, preferably the GPS antenna is arranged so that the main face of its antenna conductor portion faces the zenith, since the reception sensitivity can be improved. The following description refers to an example where the GPS antenna is integrated in a second housing (a housing to which a liquid crystal display is provided) of a notebook PC. In this case, the main face of the antenna conductor portion is required to face the zenith in a normal use state of the notebook PC (i.e., a state where the second housing is opened to have an angle of about 90 to 110° with respect to the first housing). For satisfying this condition, the GPS antenna should be arranged in the second housing in a posture such that the direction of the main face of the antenna conductor portion and the thickness direction of the second housing correspond to each other. As a result, the thickness of the second housing will be increased.

SUMMARY

An antenna unit disclosed in the present application includes: a substrate; a grounding conductor portion formed on one main face of the substrate; an antenna conductor portion formed on the main face of the substrate; and, a reflective conductor portion connected electrically to the grounding conductor portion. In the antenna unit, the antenna conductor portion and the reflective conductor portion are spaced from each other.

An electronic apparatus disclosed in the present application includes: a housing having a conductor portion; and an antenna unit fixed to the housing and connected electrically to the conductor portion. The antenna unit includes: a substrate; a grounding conductor portion formed on the substrate; an inverted-F antenna conductor portion formed on one main face of the substrate; and a reflective conductor portion connected electrically to the grounding conductor portion. In the electronic apparatus, the antenna conductor portion and the reflective conductor portion are spaced from each other.

DETAILED DESCRIPTION OF THE EMBODIMENTS

Embodiment

[1. Configuration of Electronic Apparatus]

Figure 1:
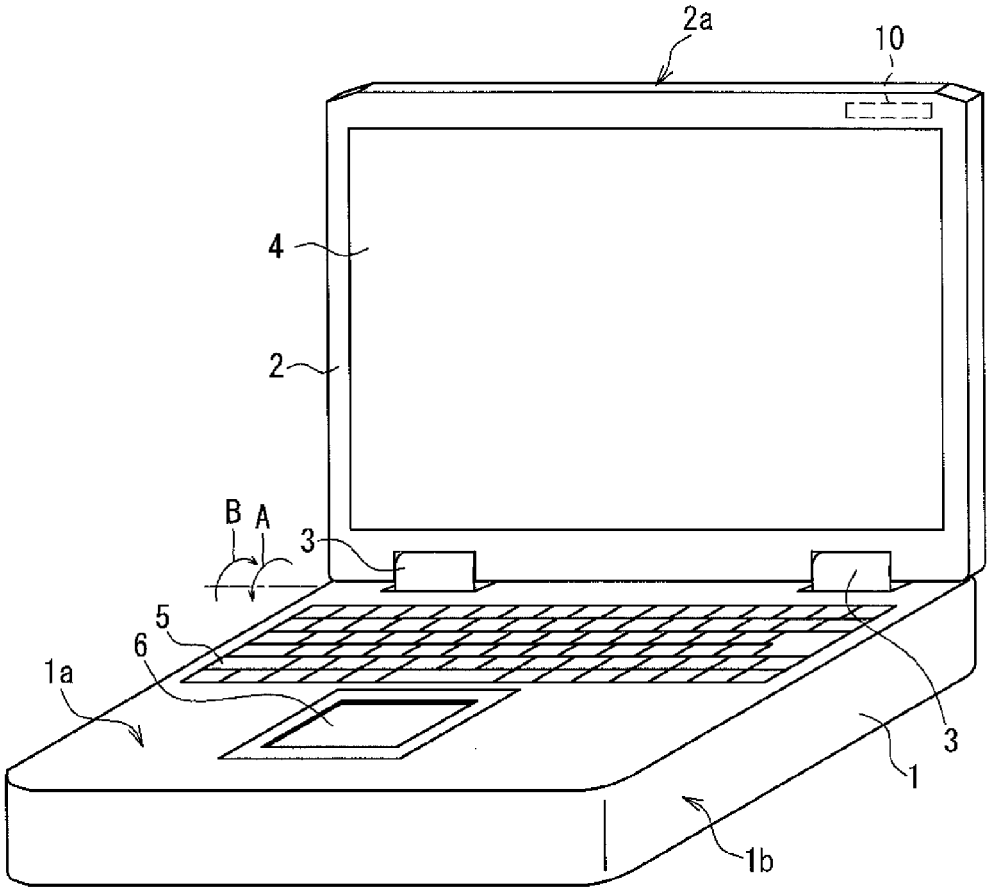
FIG. 1 is a perspective view showing a notebook PC according to an embodiment of the present application.
Figure 2:
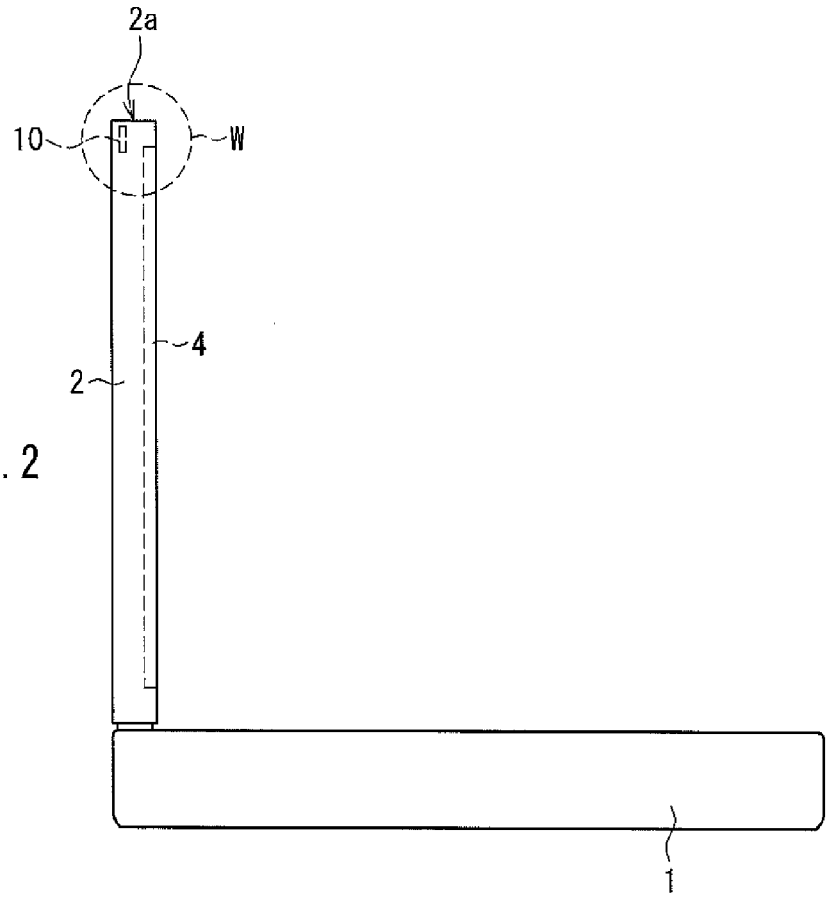
FIG. 2 is a side view showing the notebook PC.

FIG. 1 is a perspective view showing an appearance of a notebook PC as an example of an electronic apparatus according to the present embodiment. FIG. 2 is a side view showing the notebook PC. The electronic apparatus in the present embodiment is not limited to the notebook PC but any apparatus can be considered as long as it has a GPS antenna. The present application is useful particularly for a portable apparatus.

As shown in FIG. 1, the notebook PC is composed of a first housing 1 and a second housing 2. The first housing 1 includes for example a circuit board on which various electric elements are mounted and a hard disk drive. The second housing 2 has a display panel 4 (e.g., a liquid crystal display). The first housing 1 and the second housing 2 are supported rotatably to each other by hinge portions 3. The notebook PC can transfer between an open state as shown in FIG. 1 where the angle formed by the display surface of the display panel 4 and an upper face 1*a* of the first housing 1 is in a range of about 90 to 110°, and a closed state where the display surface of the display panel 4 and the upper face 1*a* of the first housing 1 oppose each other. Each of the hinge portions 3 has a shaft that supports the first housing 1 and the second housing 2 to be rotatable in any of the directions indicated with arrows A and B. On the upper face 1*a* of the first housing 1, a keyboard 5 and a pointing device 6 are arranged.

The second housing 2 is provided with a GPS antenna 10 capable of receiving electromagnetic waves radiated from GPS satellites. Since the reception sensitivity can be improved when the GPS antenna 10 is at a higher position in the zenith direction, the GPS antenna 10 is arranged in the vicinity of an upper face 2*a* of the second housing 2, which is the highest position when the notebook PC is in an open state as shown in FIG. 1. The GPS antenna 10 is composed of an inverted-F antenna module having a conductor pattern on at least either the surface or the rear face of an insulating substrate (described below). The GPS antenna 10 in the present embodiment is capable of receiving electromagnetic waves in the 1.5 GHz band.

[2. Configuration of GPS Antenna]

[2-1. Example 1]

Figure 3:
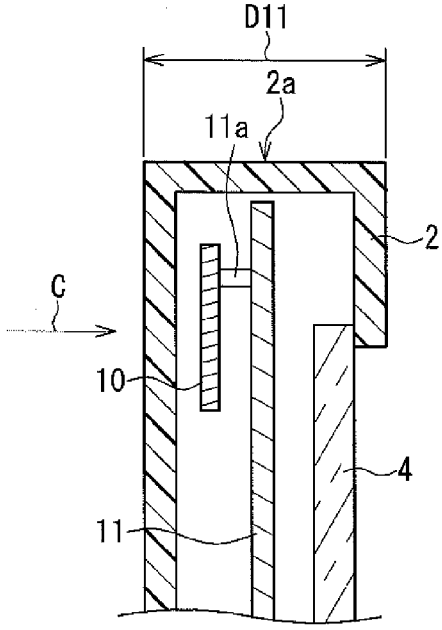
FIG. 3 is a cross-sectional view showing an encircled part W in FIG. 2.

FIG. 3 is a cross-sectional view showing an encircled part W in FIG. 2. As shown in FIG. 3, in the rearward position of the display panel 4, a metallic cabinet 11 is arranged. The metallic cabinet 11 is integrated in the second housing 2. Namely, the metallic cabinet 11 is formed integrally with for example a cylindrical grounding portion 11*a*. The GPS antenna 10 is fixed mechanically to the grounding portion 11*a* with a screw (described below) or the like, and also connected electrically to the grounding portion 11*a*.

Figure 4A:
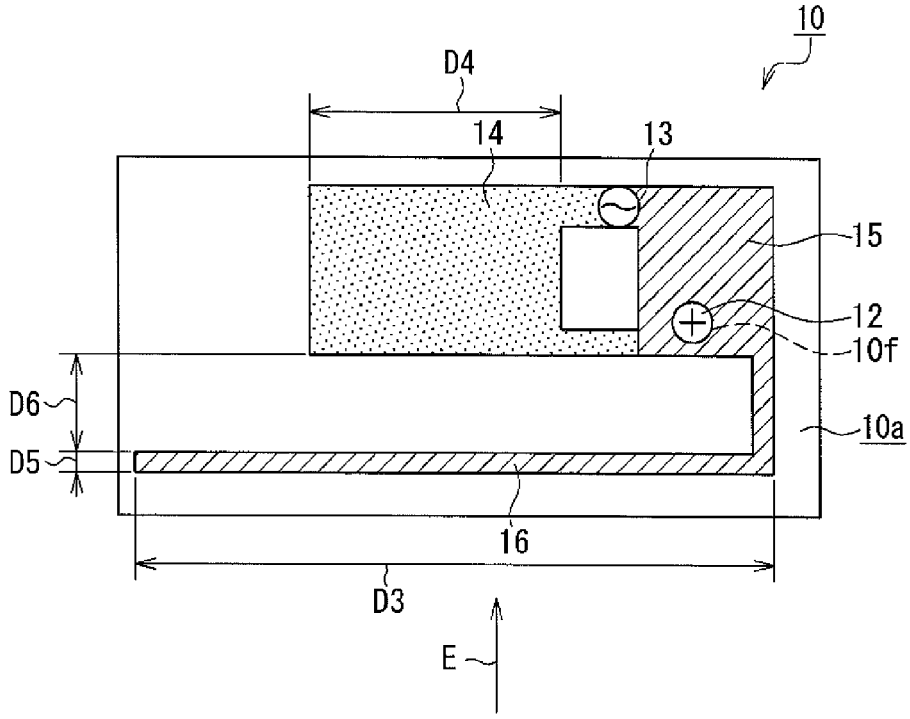
FIG. 4A is a plan view showing a GPS antenna according to Example 1.
Figure 4B:
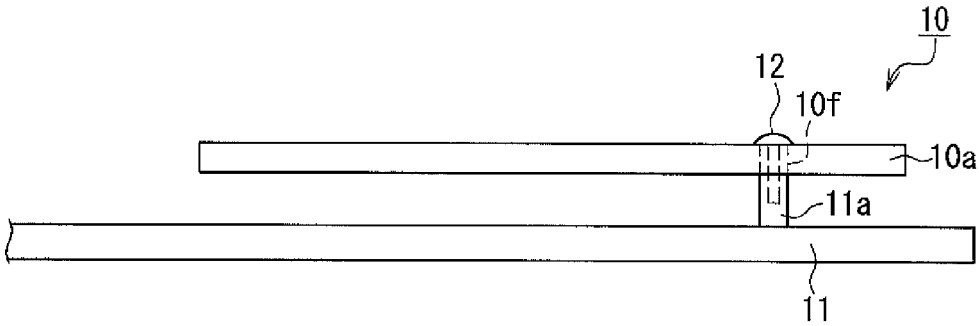
FIG. 4B is a side view showing the GPS antenna according to Example 1.

FIG. 4A is a plan view showing the GPS antenna in Example 1. Specifically, FIG. 4A is a plan view showing the GPS antenna 10 in FIG. 3 from a direction indicated with an arrow C. FIG. 4B is a side view showing the GPS antenna in FIG. 4A from a direction indicated with an arrow E. As shown in FIGS. 4A and 4B, the GPS antenna 10 is formed by providing a feeding portion 13, an antenna conductor portion 14, a grounding conductor portion 15 and a reflective conductor portion 16 on one of the main faces of the resinous insulating substrate 10*a* for example.

Specifically, the insulating substrate 10*a* is formed as a substantially rectangular resinous substrate. In the insulating substrate 10*a*, a through hole 10*f* having a conductor on the inner surface is formed. The through hole 10*f* is formed in a region where the grounding conductor portion 15 is formed. The conductor inside the through hole 10*f* is connected electrically to the grounding conductor portion 15. The conductor inside the through hole 10*f* comes to electric contact with the grounding portion 11*a* of the metallic cabinet 11 at the time the insulating substrate 10*a* is fixed to the metallic cabinet 11 with the screw 12 as shown in FIG. 4B. Therefore, by inserting the screw 12 into the through hole 10*f* and screwing into the grounding portion 11*a*, the conductor inside the through hole 10*f* and the grounding conductive portion 15 can be grounded electrically via the metallic cabinet 11.

A core wire (not shown) of a coaxial line 21 is connected electrically to the feeding portion 13 in order to feed electricity from the GPS module mounted on an electric circuit board (not shown) in the first housing 1 that is connected to the other end of the coaxial line 21.

An antenna conductor portion 14 is a conductor pattern formed on one main face of the insulating substrate 10*a*. The antenna conductor portion 14 can be formed of a metal film of copper or the like. The feeding portion 13 is connected electrically to the antenna conductor portion 14. Electric current flows on the main face of the antenna conductor portion 14 from the feeding portion 13 toward the other end of the antenna conductor portion 14. The electric current flowing toward the end of the antenna conductor portion 14 returns there and flows on the other main face of the antenna conductor portion 14 toward the grounding conductor portion 15. Then the electric current is grounded electrically to form an inverted-F antenna that resonates at a desired frequency.

The grounding conductor portion 15 is formed in the same plane as the antenna conductor portion 14 on the insulating substrate 10*a* and connected electrically to the antenna conductor portion 14. The grounding conductor portion 15 can be formed of a metal film of copper or the like. In the grounding conductor portion 15 and in a region of the insulating conductor portion 10*a* in the vicinity of the grounding conductor portion 15, a hole (not shown) for inserting the screw 12 is formed. The screw 12 is screwed into the screw hole in the grounding portion 11*a* (see FIG. 4B) via the through hole 10*f* formed in the grounding conductor portion 15 and the insulating substrate 10*a*, so that the grounding conductor portion 15 and the grounding portion 11*a* can be connected electrically, and at the same time, the insulating substrate 10 can be fixed mechanically to the metallic cabinet 11. Thereby, the grounding conductor portion 15 comes to a state being grounded electrically via the grounding portion 11*a* and the metallic cabinet 11.

A reflective conductor portion 16 is spaced by a distance D6 from the antenna conductor portion 14. The reflective conductor portion 16 can be formed of a metal film of copper or the like. The reflective conductor portion 16 is connected electrically to the grounding conductor portion 15. Therefore, the reflective conductor portion 16 has a ground potential. The reflective conductor portion 16 is formed in the same plane as the antenna conductor portion 14 and the grounding conductor portion 15 on the insulating substrate 10*a*. Though the reflective conductor portion 16 is formed of a copper foil pattern in the present embodiment, it can be provided also as a microstrip wire. It is preferable that the length D3 of the reflective conductor portion 16 is more than the length D4 of the antenna conductor portion 14. It is preferable that the width D5 of the reflective conductor portion 16 is 0.01λ or more. It is preferable that the distance D6 between the reflective conductor portion 16 and the antenna conductor portion 14 is in a range of 0.08 to 0.1λ.

When assembling the GPS antenna 10 in the second housing 2 as shown in FIG. 3, the GPS antenna 10 is arranged so that the main face of the insulating substrate 10*a* is substantially perpendicular to the upper face 2*a* of the second housing 2. By arranging the GPS antenna 10 in this manner, the thickness D11 of the second housing 2 can be decreased to provide a thinner notebook PC.

In general, when the GPS antenna 10 is arranged as shown in FIG. 3 and the notebook PC is in the open state as shown in FIG. 1, the radiation intensity of the electromagnetic wave in the zenith direction of the GPS antenna 10 is decreased and the directivity is weakened without a member that is electrically grounded vertically below the GPS antenna 10. In general, a GPS satellite is located in the zenith direction with respect to the GPS antenna. Therefore, if the zenithal directivity of the GPS antenna is weakened, the characteristic of receiving the electromagnetic wave radiated from the GPS satellite is decreased and thus the positioning accuracy of its own position will be degraded.

Therefore in the present embodiment, as shown in FIG. 4, the GPS antenna 10 is provided with the reflective conductor portion 16, and the GPS antenna 10 is arranged in the second housing 2 so that the reflective conductor portion 16 is positioned vertically below the antenna conductor portion 14 when the notebook PC is in, an open state as shown in FIG. 1. In this configuration, since the electromagnetic wave radiated from the antenna conductor portion 14 vertically downwards is grounded via the reflective conductor portion 16, the radiation intensity of the electromagnetic wave in the zenith direction is increased and the directivity is enhanced.

Figure 5:
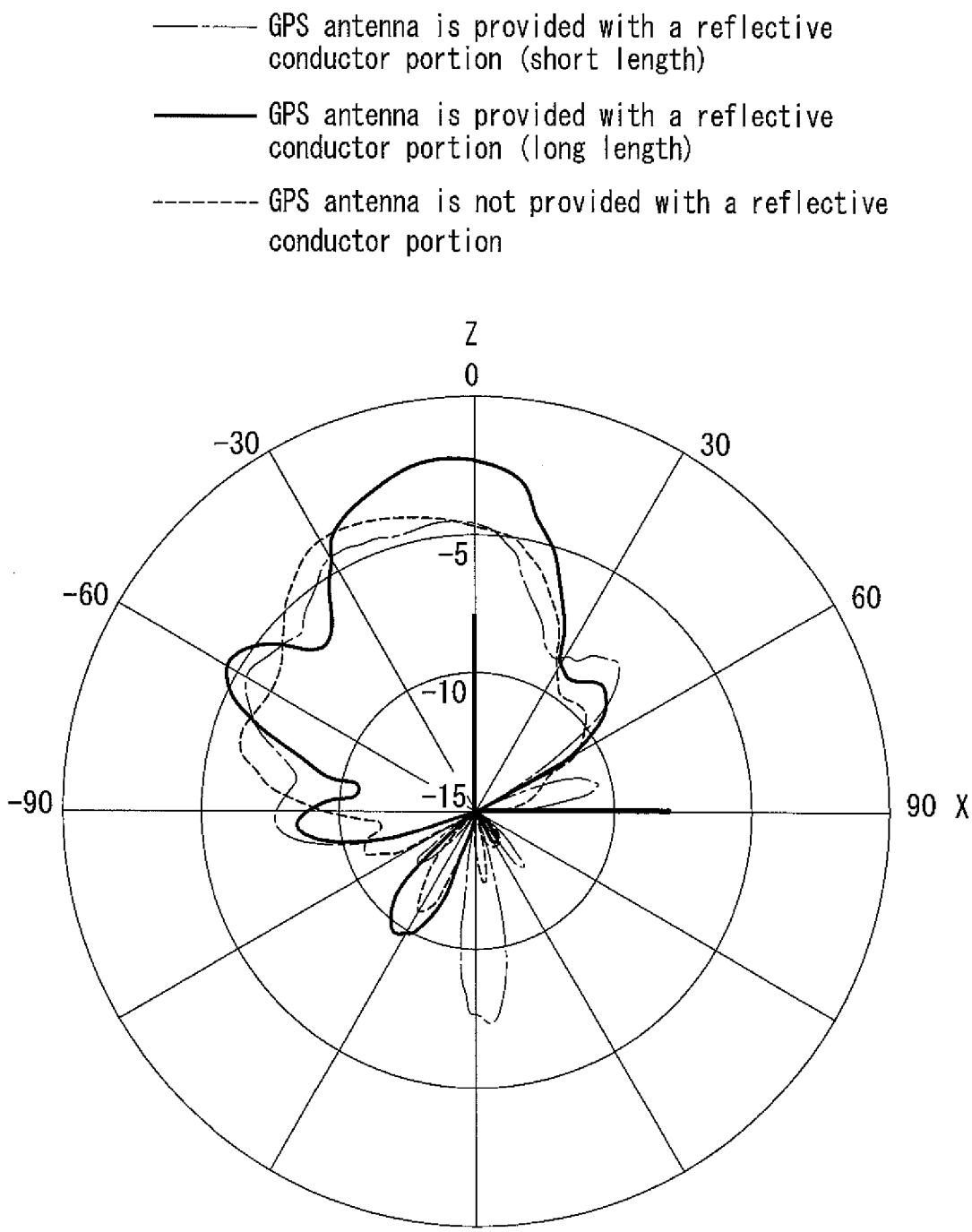
FIG. 5 is a graph showing ZX planar radiation characteristics of a GPS antenna.

FIG. 5 is a characteristic diagram showing ZX planar radiation characteristics of the GPS antenna. In FIG. 5, the characteristic indicated with a solid line denotes a radiation characteristic for a case where the length D3 of the reflective conductor portion 16 is more than the length D4 of the antenna conductor portion 14 (for example, D3=D4×2). The characteristic indicated with an alternate long and short dash line denotes a radiation characteristic for a case where the length D3 of the reflective conductor portion 16 is less than the length D4 of the antenna conductor portion 14 (for example, D3=D4×0.5). The characteristic indicated with a broken line denotes a radiation characteristic for a case where no such reflective conductor portion 16 is provided. As shown in FIG. 5, in a case where the reflective conductor portion 16 is not provided, and in a case where the length D3 of the reflective conductor portion 16 is less than the length D4 of the reflective conductor portion 14, the radiation in the Z-axis direction (zenith direction) is low and the directivity is weakened. On the other hand, in a case where the length of the reflective conductor portion 16 is more than the length D4 of the antenna conductive portion 14, the radiation intensity of the electromagnetic wave in the Z-axis direction (zenith direction) is increased and the directivity is enhanced.

[2-2. Example 2]

Figure 6A:
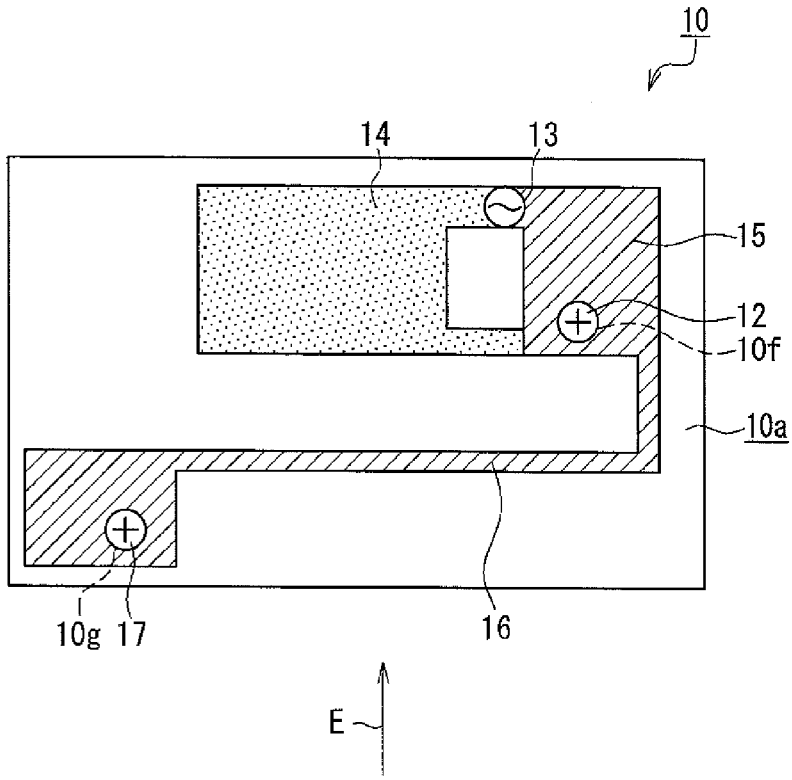
FIG. 6A is a plan view showing a GPS antenna according to Example 2.
Figure 6B:
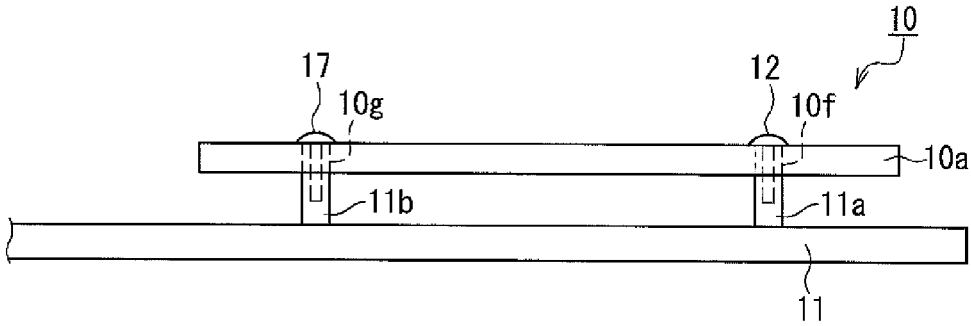
FIG. 6B is a side view showing the GPS antenna according to Example 2.

FIG. 6A is a plan view showing a GPS antenna 10 according to Example 2. FIG. 6B is a side view showing the GPS antenna in FIG. 6A from the direction indicated with an arrow E. In FIGS. 6A and 6B, components substantially identical to those of the GPS antenna 10 in Example 1 are assigned with common marks in order to avoid duplicated explanation.

In the vicinity of an end of an insulating substrate 10*a* as shown in FIGS. 6A and 6B, a through hole 10*g* for inserting a screw 17 is formed. In the reflective conductor portion 16, a hole (not shown) is formed at a position to overlap the through hole 10*g*. A conductor is formed on the inner face of the through hole 10*g*. Specifically, the conductor is formed continuously from the surface to the rear face of the insulating substrate 10*a*. The conductor is connected electrically to the reflective conductor portion 16 on one main face of the insulating substrate 10*a* and at the same time it is in electric contact with the grounding portion 11*b* of the metallic cabinet 11 on the other main face of the insulating substrate 10*a*. Namely, by inserting the screw 17 into the through hole 10*g* and screwing into the grounding portion 11*b*, the conductor inside the through hole 10*g* and the grounding portion 11*b* come to electric contact with each other, and thus the reflective conductor portion 16 can be grounded electrically. Further, the GPS antenna 10 can be fixed mechanically to the metallic cabinet 11 with the screw 17.

This configuration ensures the electrical grounding of the reflective conductor portion 16. Therefore, similar to the case of the GPS antenna 10 in Example 1, it is possible to increase the radiation intensity of the electromagnetic wave in the zenith direction and enhance the directivity. Further, since the insulating substrate 10*a* can be fixed to the metallic cabinet 11 at two sites, the strength of the attachment to: the metallic cabinet 11 is improved.

[2-3. Example 3]

Figure 7A:
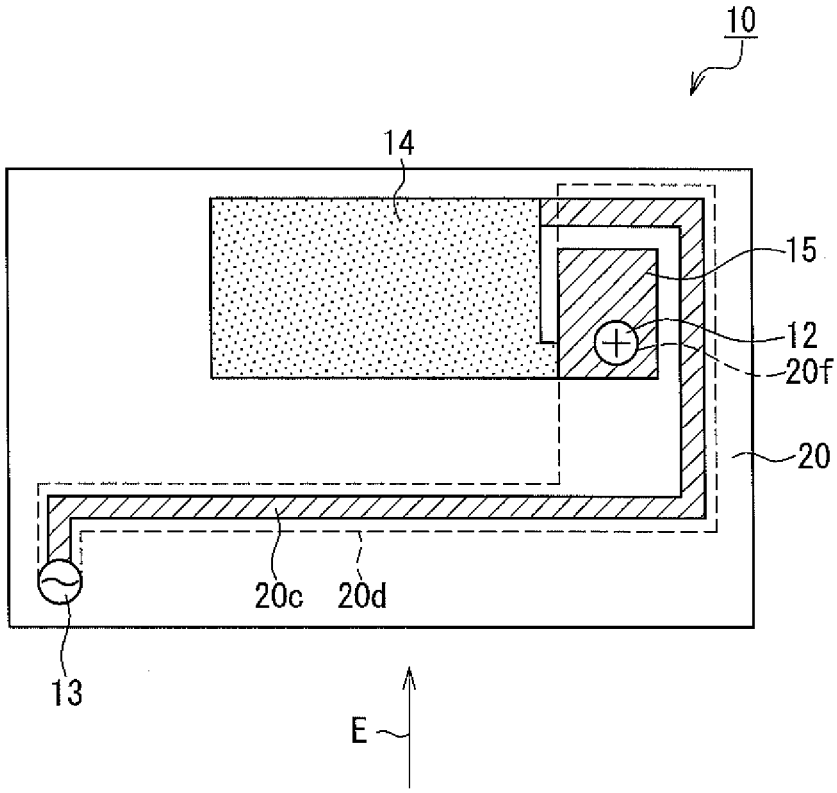
FIG. 7A is a plan view showing a GPS antenna according to Example 3.
Figure 7B:
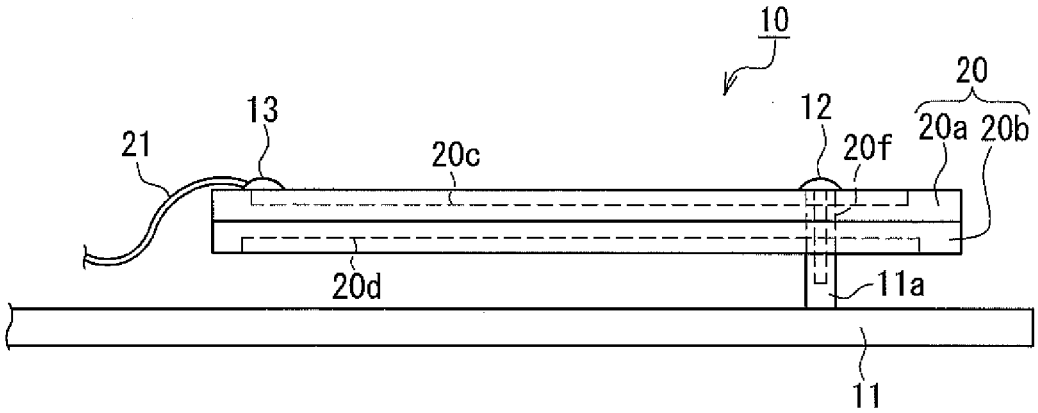
FIG. 7B is a side view showing the GPS antenna according to Example 3.

FIG. 7A is a plan view showing a GPS antenna according to Example 3. FIG. 7B is a side view showing the GPS antenna as shown in FIG. 7A from the direction indicated with an arrow E. In FIGS. 7A and 7B, components substantially identical to those of the GPS antenna 10 shown in FIG. 4 are assigned with common marks in order to avoid duplicated explanation.

The GPS antenna 10 shown in FIGS. 7A and 7B has an insulating substrate 20 of a two-layered structure. Namely, the insulating substrate 20 is prepared by laminating a first layer 20*a* and a second layer 20*b*.

The first layer 20*a* is provided with a feeding portion 13, an antenna conductor portion 14, a grounding conductor portion 15, and a feeding pattern 20*c*. A coaxial line 21 is connected electrically to the feeding portion 13, thereby feeding electricity. A through hole 20*f* having a conductor on the inner surface is formed in the insulating substrate 20, for inserting a screw 12. The through hole 20*f* connects the surface and the rear face of the insulating substrate 20. The conductor inside the through hole 20*f* is connected electrically to the grounding conductor portion 15 and to the reflective conductor portion 16. The feeding pattern 20*c* is formed along the longitudinal direction of the insulating substrate 20, connected electrically at one end to the feeding portion 13, while connected electrically at the other end to the antenna conductor portion 14. Therefore, an electric current to be fed to the feeding portion 13 via the coaxial line 21 will be fed to the antenna conductor portion 14 via the feeding pattern 20*c*. The feeding pattern 20*c* may be formed of a copper foil pattern or may be formed of a microstrip line.

The second layer 20*b* is provided with a reflective conductor portion 20*d*. The reflective conductor portion 20*d* is formed along the longitudinal direction of the insulating substrate 20. The reflective conductor portion 20*d* is connected electrically at one end to the conductor inside the through hole 20*f* formed in the insulating substrate 20, and at the same time, in electric contact with the grounding portion 11*a*. The conductor inside the through hole 20*f* is connected electrically to the grounding conductor portion 15 and to the reflective conductor portion 20*d*. Therefore, by inserting a screw 12 into the through hole 20*f* and screwing into the grounding portion 11*a*, the reflective conductor portion 20*d* can come into electric contact with the grounding portion 11*a*. In this manner, it is possible to ground electrically the grounding conductor portion 15, the conductor inside the through hole 20*f* and the reflective conductor 20*d*, via the metallic cabinet 11. The reflective conductor portion 20*d* may be formed of a copper foil pattern or may be formed of a microstrip line.

With the configuration, the feeding portion 13 can be arranged at any desired position in the insulating substrate 20, and thus the degree of freedom in the shape of the GPS antenna 10 is improved.

Further, since the feeding portion 13 is spaced from the antenna conductor portion 14 and since the feeding portion 13 and the antenna conductor portion 14 are connected to each other with a feeding pattern 20*c* formed of a microstrip line or the like, the coaxial line 21 can be spaced from the antenna conductor portion 14. Therefore, the antenna conductor portion 14 can be configured to be impervious to the unnecessary radiation from the coaxial line 21, and thus the sensitivity in receiving the electromagnetic wave can be improved. In an alternative configuration, the reflective conductor portion 20*d* may be grounded to the metallic cabinet 11 similarly to Example 2.

[3. Effect of Embodiment, and the Other]

According to the present embodiment, since the reflective conductor portion 16 is provided to the GPS antenna 10, the electromagnetic wave radiated from the antenna conductor portion 14 in a predetermined direction can be grounded electrically, and the radiation of the electromagnetic wave in a direction (arbitrary direction) opposite to the predetermined direction can be enhanced. Therefore, the directivity of the electromagnetic wave in the arbitrary direction can be enhanced and the positioning accuracy can be improved.

Further, according to the present embodiment, the GPS antenna 10 is arranged in the second housing 2 so that the reflective conductor portion 16 is positioned vertically below the antenna conductor portion 14 when the second housing 2 is placed to have an open/close angle of about 90 to about 110° with respect to the first housing 1. Thereby, the electromagnetic wave radiated from the antenna conductor portion 14 vertically downwards can be grounded electrically by the reflective conductor portion 16. Therefore, the radiation intensity of the electromagnetic wave in the zenith direction can be enhanced, and thus the directivity in the zenith direction can be enhanced. As a result, the positioning accuracy can be improved.

Further, according to the present embodiment, the main face of the insulating substrate 10*a* is positioned to be perpendicular to the upper face 2*a* of the second housing 2, and thus the GPS antenna 10 can be integrated without increasing the thickness D11 of the second housing 2.

In the present embodiment, the GPS antenna 10 is fixed to the metallic cabinet 11 mechanically and electrically, thereby connecting the ground potential of the GPS antenna 10 to the metallic cabinet 11. Alternatively, the GPS antenna 10 may be fixed to an insulating cabinet on which a conductive sheet or the like has been adhered.

Further, the present application is not limited to the embodiment where a conductor inside the through hole 10*f* is used to connect electrically the grounding conductor portion 15 on the insulating substrate 10*a* and the metallic cabinet 11. Though not shown, it is preferable to provide, aside from the through hole 10*f*, a plurality of conductive patterns that pierce the insulating substrate 10*a* so as to connect electrically the surface and the rear face of the insulating substrate 10*a*, and to connect at plural sites to the grounding conductor portion 15 and to the metallic cabinet 11.

Figure 8:
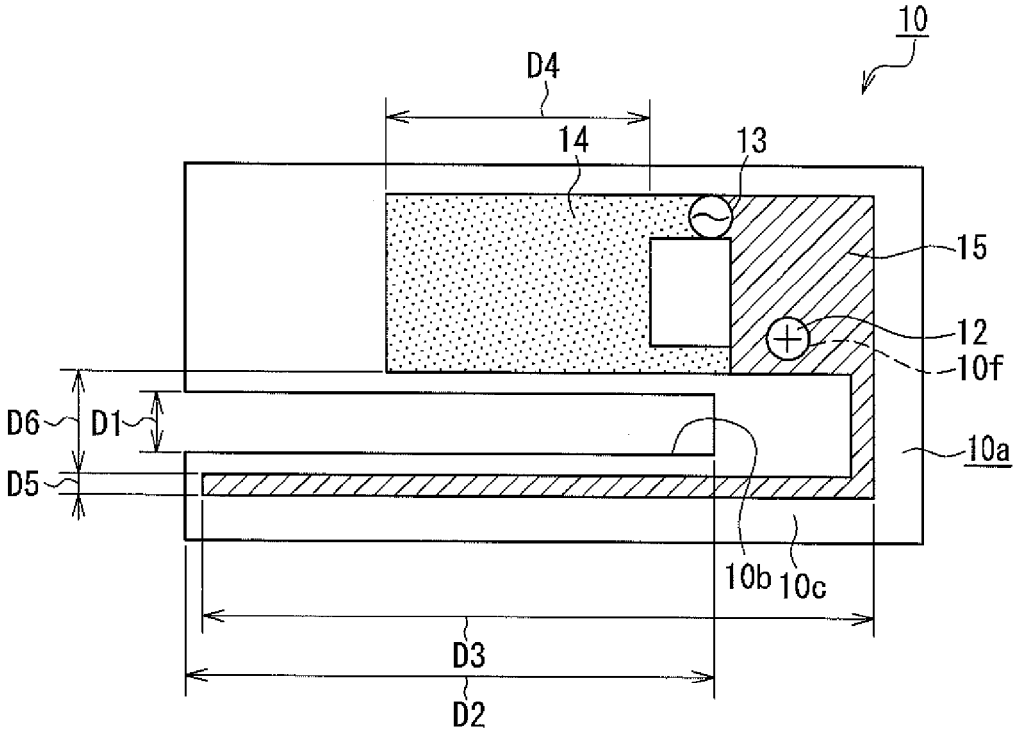
FIG. 8 is a plan view showing a variation of a GPS antenna according to the embodiment of the present application.

Further in the present embodiment, both the insulating substrates 10*a* and 20 are shaped to have rectangular planes. Alternatively, as shown in FIG. 8, a hollow may be formed between the antenna conductor portion 14 and the reflective conductor portion 16. As shown in the plan view of FIG. 8, a hollow 10*b* having a width D1 and a length D2 is formed at a part of a substantially rectangular insulating substrate 10*a*. And on the insulating substrate 10*a*, an extension 10*c* opposing the antenna conductor portion 14 across the hollow 10*b* is formed. In other words, the insulating substrate 10*a* is substantially U-shaped. A through hole 10*f* having a conductor on the inner surface is formed in the insulating substrate 10*a*. The through hole 10*f* is formed in a region in which the grounding conductor portion 15 is formed. The conductor inside the through hole 10*f* is connected electrically to the grounding conductor portion 15. When the insulating substrate 10*a* is fixed to the metallic cabinet 11 (see FIG. 4B for example) with the screw 12, the conductor inside the through hole 10*f* will be in electric contact with the grounding portion 11*a* (see FIG. 4B for example) of the metallic cabinet 11. Therefore, by inserting the screw 12 into the through hole 10*f* and screwing into the grounding portion 11*a* (see FIG. 4B for example), the conductor inside the through hole 10*f* and the grounding conductor portion 15 can be grounded electrically via the metallic cabinet 11 (see FIG. 4B for example).

The insulating substrates 10*a* and 20 in the present embodiment represent a substrate. The grounding conductor portion 15 in the present embodiment represents a grounding conductor portion. The antenna conductor portion 14 in the present embodiment represents an antenna conductor portion. The reflective conductor portions 16 and 20*d* represent a reflective conductor portion. The metallic cabinet 11 in the present embodiment represents a metallic cabinet. The first housing 1 in the present embodiment represents a first housing. The second housing 2 in the present embodiment represents a second housing. And the feeding pattern 20*c* in the present embodiment represents a transmission line.

The present application is useful for an antenna unit and an electronic apparatus provided with the antenna unit.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electronic apparatus comprising:

a housing having a conductor portion; and an antenna unit fixed to the housing and connected electrically to the conductor portion, the antenna unit comprising:

a substrate;

a grounding conductor portion formed on one main face of the substrate;

an antenna conductor portion formed on the main face of the substrate; and a reflective conductor portion formed on the main face of the substrate, wherein the antenna conductor portion and the reflective conductor portion are spaced from each other, and the reflective conductor portion extends in an extension direction of the antenna conductor portion and has a length equal to or more than the length of the antenna conductor portion, the conductor portion has a protrusion capable of supporting the antenna unit in a predetermined posture, the substrate of the antenna unit is fixed to the protrusion so that one of the main faces of the substrate opposes the conductor portion of the housing with a predetermined distance therebetween and is arranged at a position to overlap the conductor portion of the housing when viewed in the thickness direction of the substrate, the grounding conductor portion and the reflective conductor portion are grounded via the protrusion and the conductive portion of the housing, and in a practical use state of the electronic apparatus, the antenna unit is fixed to the protrusion of the conductor portion in a posture so that the reflective conductor portion is positioned vertically below the antenna conductor portion.

2. The electronic apparatus according to claim 1, wherein the housing is composed of a first housing and a second housing supported rotatably to the first housing, and the antenna unit is fixed to the second housing so that the reflective conductor portion is positioned vertically below the antenna conductor portion when the first housing and the second housing are located at a distance from each other.

3. The electronic apparatus according to claim 2, wherein the first housing comprises an electric circuit board;

the second housing comprises a display panel; and the substrate of the antenna unit is fixed to the second housing so that at least one of the main faces of the substrate is parallel to a display surface of the display panel.

4. An electronic apparatus comprising:

a housing having a conductor portion; and an antenna unit fixed to the housing and connected electrically to the conductor portion, the antenna unit comprising:

a substrate comprising first and second layers;

a grounding conductor portion formed on a main face of the first layer of the substrate;

an antenna conductor portion formed on the main face of the first layer of the substrate; and a reflective conductor portion formed on a main face of the second layer of the substrate, wherein the first layer forming the substrate comprises a feeding pattern, where one end of the feeding pattern is connected electrically to a feeding portion; and the other end of the feeding pattern is connected electrically to the antenna conductor portion, and wherein the antenna conductor portion and the reflective conductor portion are spaced from each other, and the reflective conductor portion extends in an extension direction of the antenna conductor portion and has a length equal to or more than the length of the antenna conductor portion, the conductor portion has a protrusion capable of supporting the antenna unit in a predetermined posture, wherein the conductor portion is a planar member having a main face, and the conductor portion is arranged so that the main face is substantially parallel to a main face of the housing, the substrate of the antenna unit is fixed to the protrusion so that one of the main faces of the substrate opposes the conductor portion of the housing with a predetermined distance therebetween and is arranged at a position to overlap the conductor portion of the housing when viewed in the thickness direction of the substrate, the grounding conductor portion and the reflective conductor portion are grounded via the protrusion and the conductive portion of the housing, and in a practical use state of the electronic apparatus, the antenna unit is fixed to the protrusion of the conductor portion in a posture so that the reflective conductor portion is positioned vertically below the antenna conductor portion.

5. The antenna unit according to claim 4, wherein the feeding pattern is formed of a microstrip line.

6. The electronic apparatus according to claim 1, wherein the conductor portion is a planar member having a main face, and the conductor portion is arranged so that the main face is substantially parallel to a main face of the housing.

* * * * *